US007024707B2

(12) United States Patent
Gagosz

(10) Patent No.: US 7,024,707 B2
(45) Date of Patent: Apr. 11, 2006

(54) PUBLIC CONVENIENCE HAVING A SEPARATED URINAL

(75) Inventor: Jean-Claude Gagosz, 2 rue des Halles (FR)

(73) Assignee: J.C. Decaux International, Neuilly-sur-Seine ( * ) Notice: Subject to any disclaimer, the term of this patent is extended or adjusted under 35 U.S.C. 154(b) by 69 days.

(21) Appl. No.: 10/885,151

(22) Filed: Jul. 6, 2004

(65) Prior Publication Data

US 2005/0022293 A1 Feb. 3, 2005

(30) Foreign Application Priority Data

Jul. 4, 2003 (FR) ..... 03 08196

(51) Int. Cl.
*A47K 4/00* (2006.01)
*E03C 1/01* (2006.01)

(52) U.S. Cl. ..... 4/664

(58) Field of Classification Search ..... 4/662, 4/664

See application file for complete search history.

(56) References Cited

U.S. PATENT DOCUMENTS

| | | | | |
|---|---|---|---|---|
| 3,869,732 A | | 3/1975 | Garvey et al. | |
| 4,470,227 A | | 9/1984 | Bigelow, Jr. et al. | |
| 4,488,321 A | | 12/1984 | Brunton | |
| 4,642,821 A | * | 2/1987 | Zanuso et al. | 4/662 |
| 5,647,074 A | * | 7/1997 | White et al. | 4/664 |
| 2004/0163170 A1 | * | 8/2004 | Cooper et al. | 4/664 |

FOREIGN PATENT DOCUMENTS

| | | |
|---|---|---|
| EP | 0 645 499 | 3/1995 |
| FR | 1463161 | 11/1965 |
| FR | 2590293 | 5/1987 |
| FR | 2 744 743 | 8/1997 |
| FR | 2805293 | 8/2001 |
| GB | 370829 | 4/1932 |
| GB | 1238670 | 7/1971 |

OTHER PUBLICATIONS

Preliminary Search Report for FR 0308196 dated Mar. 4, 2004.

* cited by examiner

*Primary Examiner*—Charles E. Phillips
(74) *Attorney, Agent, or Firm*—Marshall, Gerstein & Borun LLP

(57) ABSTRACT

There is provided a convenience (1) comprising a sanitary compartment (7) having a toilet bowl (8), and an equipment room (10) separated from the sanitary compartment (7) and accessible through a door (16) from the outside of the convenience (1), independent from the sanitary compartment access, said convenience (1) further comprising a urinal (32), which is at least partly formed in the door (16) of the equipment room (10) and separated from the sanitary compartment (7).

13 Claims, 6 Drawing Sheets

PUBLIC CONVENIENCE HAVING A SEPARATED URINAL

The invention relates to public conveniences.

Generally, public conveniences comprise a sanitary compartment having a toilet bowl suitable for all needs of the public.

One may refer to the French patent application filed by the applicant, published under number FR-A-2 805 293.

Public conveniences of that kind are satisfactory, for they answer immediately the needs of the public.

However, one may have a simple walk on the street during rush hour and witness waiting lines before the entries of such public conveniences.

Indeed, on the one hand, such public conveniences need some handling from the user, and, on the other hand, one has to wait, between two consecutive utilizations, for the sanitary compartment to be washed.

Although progress has been made in this field, one has often to wait several minutes, and it happens that some people (mostly men) prefer some more immediate solutions to satisfy their needs, which is contrary to public hygiene.

The invention aims, in particular, at remedying the aforementioned drawbacks, by providing a public convenience which makes it possible to increase the number of users while achieving water and energy savings.

To this end, the invention is directed to a convenience comprising a sanitary compartment having a toilet bowl, and an equipment room separated from the sanitary compartment and accessible through a door from the outside of the convenience, independent from the sanitary compartment access, said convenience further comprising a urinal, which is at least partly formed in the door of the equipment room and separated from the sanitary compartment.

Therefore, two persons can simultaneously use the convenience, thereby increasing the number of visits thereof.

In addition, men can satisfy quickly their immediate needs without having to access the sanitary compartment, which provides simplicity of use and allows substantial water and energy savings.

Furthermore, involving the door of the equipment room for making the urinal also allows substantial space and cost savings.

Also, the urinal may, at least partly, extend within the equipment room, so that the existing space is utilized without making it necessary to increase the overall dimensions of the public convenience.

The urinal comprises e.g. a collecting basin which encroaches on the floor of the equipment room, and a front wall formed in the door of the equipment room, said front wall preferably extending along the basin contour. The basin contour may be circular, so that the front wall is substantially cylindrical.

In addition, a grille may be mounted onto the collecting basin, said grille being able to support a person's weight.

Furthermore, the convenience may comprise a water supply suitable for forming a water curtain running onto the surface of the front wall. This water supply comprises e.g. a water tank, located above the urinal, which drains into the urinal under control of an appropriate device.

In order to provide laminar water flow, it is preferable to coat the front wall with a hydrophilic substance.

In addition, access to the urinal may be restricted through a moving gate. The convenience may also be provided with a weather-board located above the urinal, in order to shield the users from bad weather.

Moreover, the convenience may be equipped with a footboard, located before the urinal.

The above and other objects and advantages of the invention will become apparent from the detailed description of preferred embodiments of the invention, considered in conjunction with the accompanying drawings.

FIG. 1 shows a public convenience 1 suitable for being installed on public areas in order to satisfy public needs. As will be disclosed hereafter, the public convenience 1 is designed to allow easy access to wheelchair handicapped persons.

Convenience 1 comprises a frame 2 having a global parallelepipedic shape, which comprises two side walls 3, 4 the ends of which are linked by two back walls 5, 6.

Figure 1:
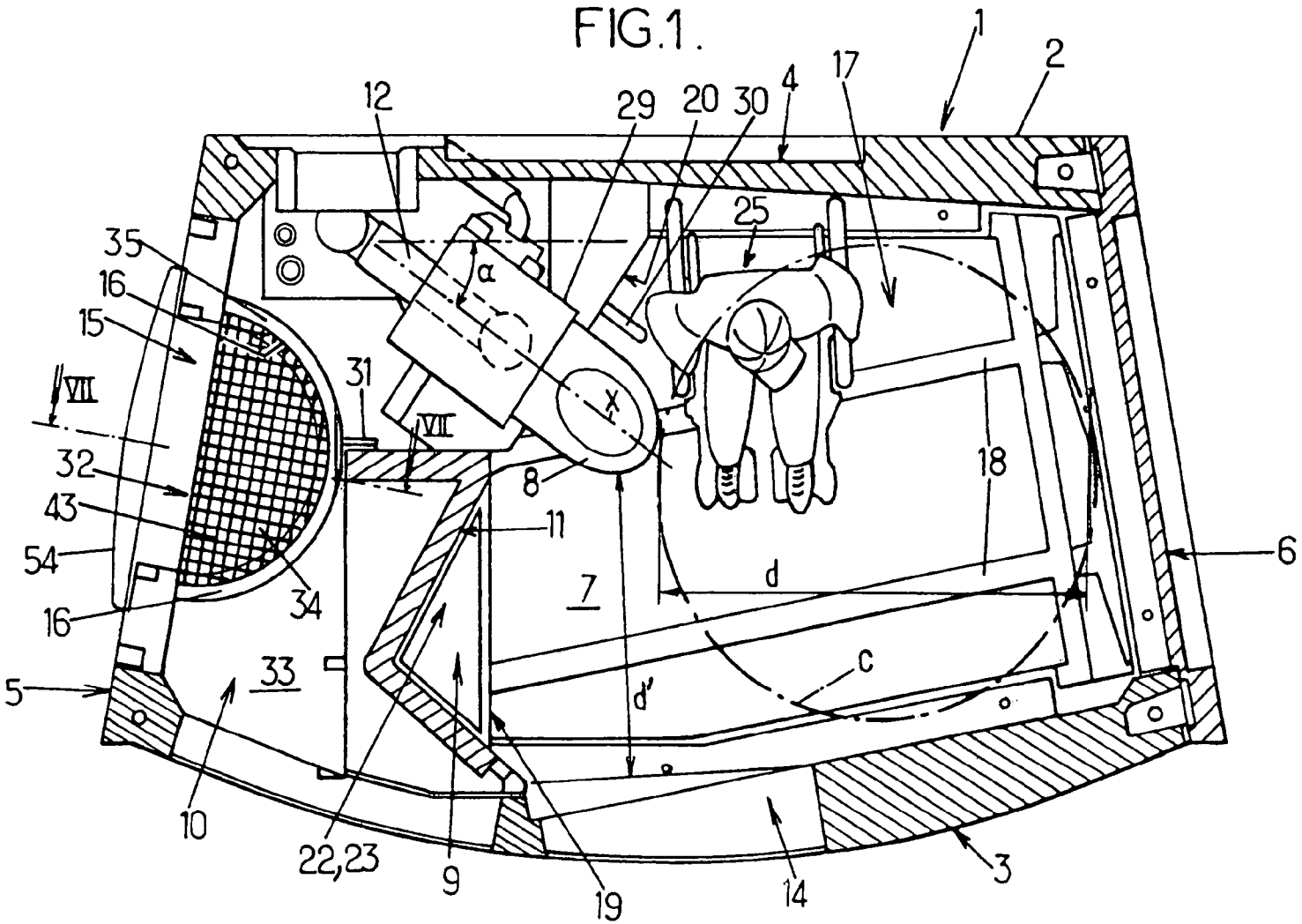
FIG. 1 is a top cut view of a public convenience.
Figure 3:
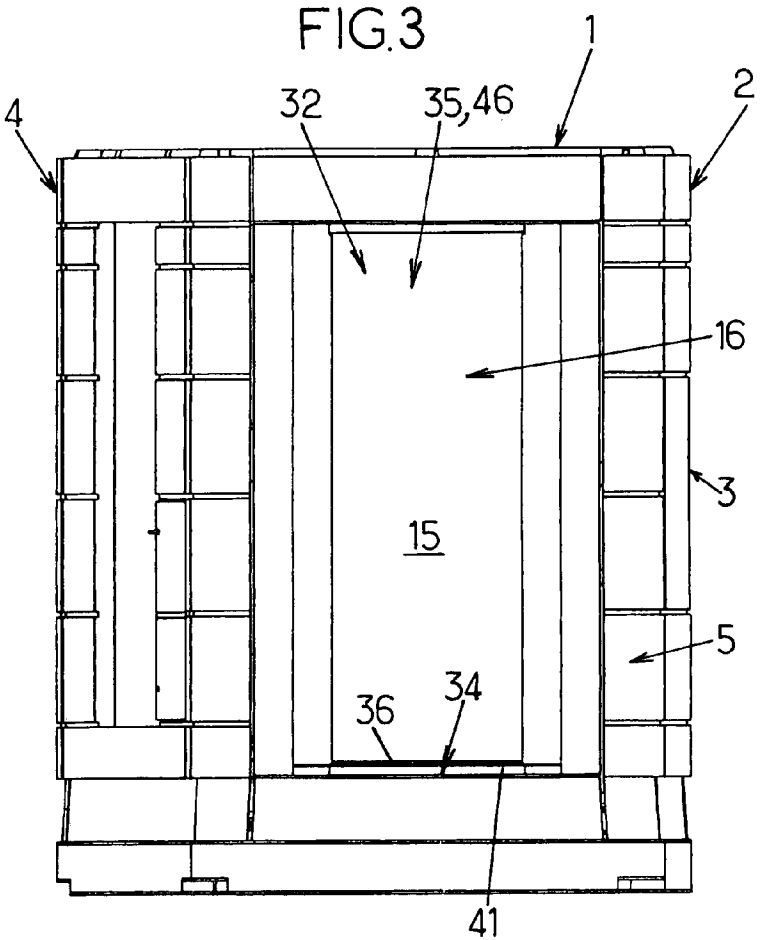
FIG. 3 is a side view of the public convenience of FIG. 2, taken along direction III.
Figure 2:
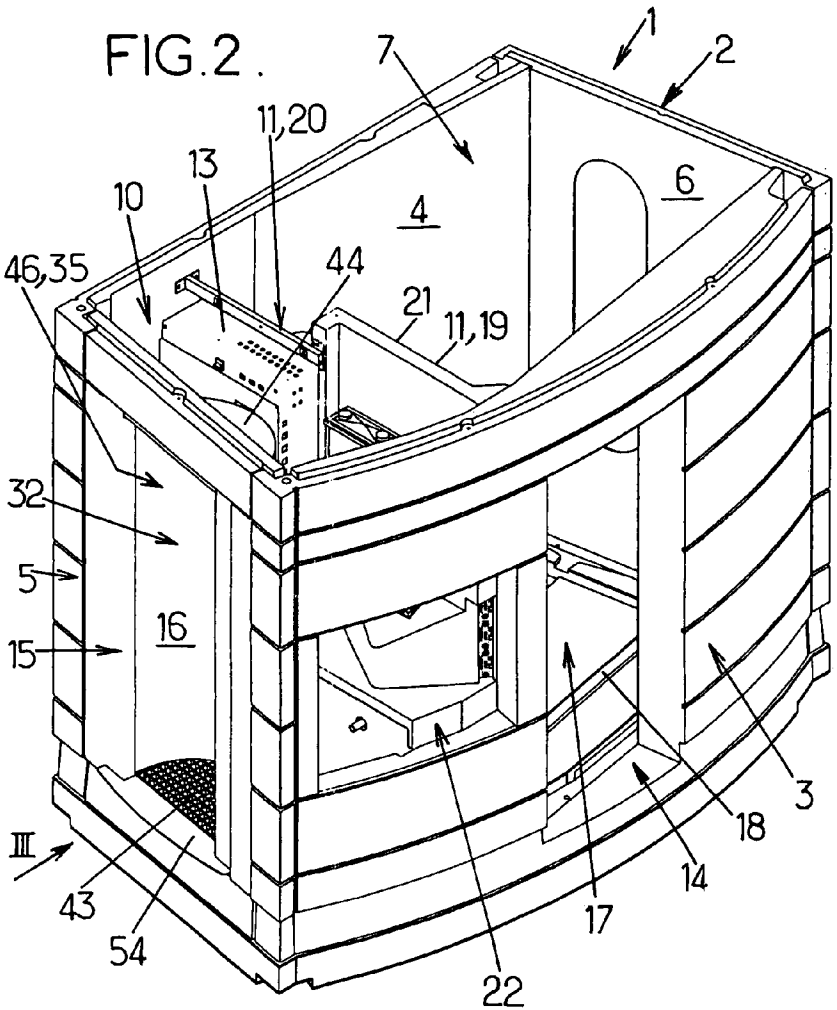
FIG. 2 is a perspective view of the public convenience of FIG. 1.

As depicted on FIG. 1, convenience 1 is compartmented: indeed, it comprises a sanitary compartment 7, equipped with a toilet bowl 8 and with a lavatory basin 9, and an equipment room 10 separated from the sanitary compartment by a dividing wall 11 which prevents the public from accessing the equipment room 10 from the sanitary compartment 7.

The equipment room 10 encloses equipment suitable for operation of the convenience 1, i.e.: water pump(s) (not shown), evacuating conduits 12 for the lavatory 9 and/or the toilet bowl 8, and an electric cabinet 13 enclosing electric connections and an automated control system for the convenience 1.

One side wall 3 of the frame 4, so-called front wall, has an opening 14 equipped with a door (not shown) and forming an entry giving access to the sanitary compartment (this access may be restricted through a payment system), whereas the opposite wall 4 is blind.

Back wall 5, adjacent the equipment room 7, has a second opening 15 equipped with a pivoting door 16 (which might be of the sliding type) and forming an entry giving access (public-restricted) to the equipment room 10, whereas the opposite back wall 6 is blind.

The door 16 of the equipment room 10, which presents some specificity discussed hereafter, will be disclosed hereunder. Let us come back to the sanitary compartment 7.

Sanitary compartment 7 encloses a manoeuvre zone 17, which is limited by blind side wall 4, front wall 3, blind back wall 6, and dividing wall 11, and which is equipped with a floor (not shown) covering conduits 18 for a floor cleaning system providing water projection, said conduits 18 linking the equipment room 10 to the blind back wall 6, as depicted on FIG. 1 (this cleaning system will not be described in detail).

Figure 4:
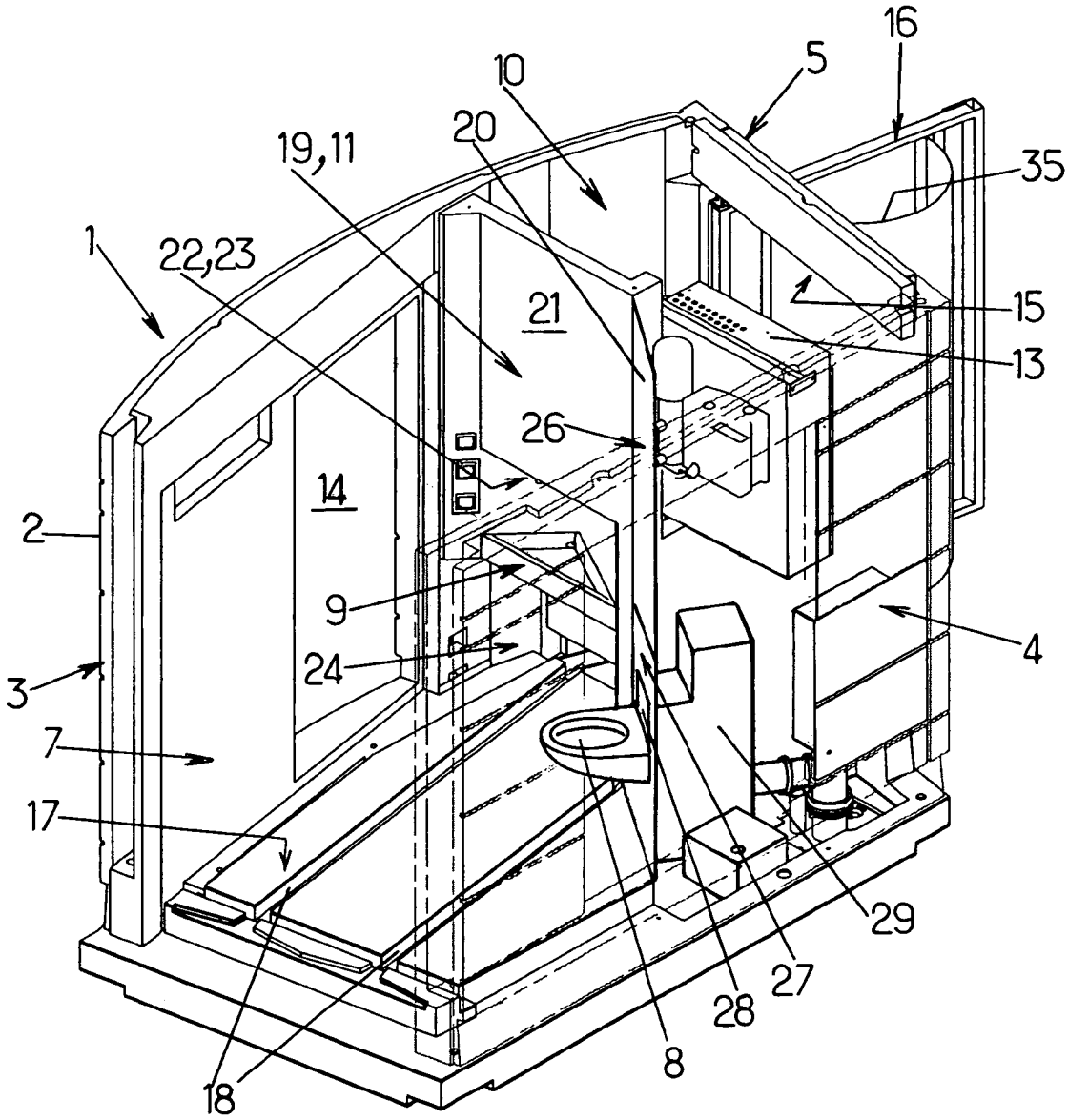
FIG. 4 is a perspective view, with some parts torn away, of the public convenience of FIG. 2, along another angle of sight.

As depicted on FIGS. 1 and 4, the dividing wall 11 is formed of two parts 19, 20 and comprises a first panel 19 which forms—or supports—the lavatory 9, and a second panel 20 which supports the toilet bowl 8.

The first panel 19 is located on the side of the front wall 3, near the entry 14, whereas the second panel 20, which is adjacent the first one 19, is located on the side of the blind side wall 4.

In other words, the toilet bowl 8 is located on the side of the blind side wall 4, whereas the lavatory 9 is adjacent the toilet bowl 8 on the side opposite the blind side wall 4, that is to say on the side of the entry 14.

This is practical for wheelchair handicapped persons, and permits the grouping of evacuation conduits on the same side of the public convenience 1 (i.e. in the equipment room 10), which is therefore compact and easy to manufacture.

As depicted on FIG. 1, the first panel 19 extends substantially perpendicular to side walls 3, 4. First panel 19 comprises, in its top portion, a planar facade 21 which covers, on the side of the equipment room 10, technical parts of the lavatory 9 (soap distribution, water supply, possibly dryer—not shown). In its lower part, panel 19 forms a niche 22 in which the lavatory 9 is disposed.

Above the lavatory 9, the niche 22 forms an alcove 23 providing sufficient room for the hands of a person wishing to wash them, whereas under the lavatory 9, the niche 22 forms a recess 24 (FIG. 4) providing sufficient room for the legs of a handicapped person in a wheelchair 25.

Second panel 20 comprises an upper portion 26 which forms a door providing partial access (public-restricted) to the equipment room 10, in particular to the sanitary equipment of the toilet bowl, and a lower portion 27 in which the toilet bowl 8 is anchored.

More precisely, the toilet bowl 8 is mounted on a retractable support 28 which, during cleaning operations of the sanitary compartment 7, is able to pivot toward the inside of a cleaning unit 29 located behind the panel 20, on the side of the equipment room 10 (FIG. 1).

The toilet bowl 8 extends along an axis X, perpendicular to the panel 20, which forms an angle $\alpha$ with the blind side wall 4. In other words, the second panel 20 presents and angular offset with respect of a plane perpendicular to the blind side wall 4.

Accordingly, although the toilet bowl 8 is anchored on the side of the blind side wall 4 (in order to facilitate access, on the opposite side, for a wheelchair handicapped person), it extends (along its axis) toward the center of the manoeuvre zone 17.

Therefore, there is provided between the toilet bowl 8 and the blind side wall 4 a room allowing access to the toilet bowl on this side, for a wheelchair handicapped person.

Practically, several features permit an optimization of the available space in function of the configuration of sanitary compartment 7.

Indeed, the toilet bowl 8 can be oriented so that the angle $\alpha$ formed between the axis X and the blind side wall 4 is comprised between 20° and 70°, a value of about 35° constituting a good compromise (see FIG. 1).

Therefore, handicapped persons in a wheelchair 25 can access the toilet bowl 8 either by its left side (i.e. on the side of the entry 14) or by its right side (i.e. on the side of the blind side wall 4), in somewhat equivalent conditions.

Practically, there is provided between the toilet bowl 8 and the side wall 4 sufficient space for a wheelchair 24 to be parked right next to the toilet bowl 8, on the right side thereof (as depicted on FIG. 1), and for the handicapped person to move easily from the wheelchair to the toilet bowl 8 and vice-versa. One or more handrail (possibly retractable), anchored in the wall 20 near the toilet bowl 8, may help this person move.

The comfort and safety is thereby increased for handicapped persons, whereas there is no need for increasing the surface area of the manoeuvre zone 17.

The space provided between the toilet bowl 8 and the entry opening 14 is also made sufficient for a wheelchair to be temporarily parked in the same conditions.

In addition, it is possible to set the distance d between the end of the toilet bowl 8 and the blind back wall 6 in function of the volume of the space it is desired to provide between them.

This distance d shall be chosen at least equal to 80 cm, which permits easy access to the toilet bowl on the side of the side wall 4. More comfort shall be provided with a distance d comprised between 95 cm and 125 cm.

Practically, as shown on FIG. 1, the circle of evolution C (the diameter of which is more than 150 cm), which by definition allows complete freedom of movement to wheelchair handicapped persons, is fully included into the manoeuvre zone 17 (see the circle in dashed lines in FIG. 1).

It shall be noted that the distance d' between the edge of the toilet bowl 8 and the opening 14 shall be chosen also at least equal to 80 cm, in order to provide good comfort and safety.

It shall also be noted that the dividing wall 11 is preferably at least partly of the detachable type.

As the dividing wall 11 is in two parts 19, 20, it is possible to mount in a detachable way at least one of the panels 19, 20, or both of them, as provided in the embodiment illustrated on FIG. 1.

For example, the first panel 19, which may be concrete-manufactured, is mounted on a base 31 formed in the floor of the convenience 1, and then screwed to the front wall 3.

The upper portion 26 and under portion 27 may be attached to vertical posts, one post being adjacent the first panel 19, whereas another post is adjacent the blind side wall 4. As described hereabove, the upper portion 26—preferably metallic—shall form a door: it may therefore be pivotally mounted on the corresponding post.

Accordingly, the public convenience 1 is of the modular type. Therefore, with an inclined toilet bowl 8 as described hereabove may equip a single-typed frame 2. In addition, in case some damage should occur, it is possible to replace any of the panels 19, 20.

According to another aspect, as depicted on the figures, the convenience 1 comprises, in addition to the sanitary compartment 7 in which the toilet bowl 8 is provided for satisfying all kinds of needs of the public, a urinal 32 separated from the sanitary compartment 7 and accessible, from the exterior of the convenience, independent from the sanitary compartment 7.

Therefore, men can satisfy their immediate needs without being obliged to use the sanitary compartment 7, which would make them stop by during a long time. This also results in saving water and electricity ordinarily necessary for operating and cleaning the sanitary compartment.

As depicted on FIG. 1, the urinal 32 is accessible through a second opening 15, distinct from the first opening 14 providing access to the sanitary compartment 7, so that two persons may be satisfied at the same time.

In order to better utilize the available space, the urinal 32 extends, at least partly, in the equipment room 10, which is accessed:

everyday, only for evacuating garbage (paper, newspapers, cans) drained by the water provided by the floor cleaning device to a tank 33 located behind the first panel 19, and sometime, to permit repairing or checking of the technical equipment.

Practically, the urinal 32 is at least partly formed in the door 16 which closes the equipment room 10.

Figure 5:
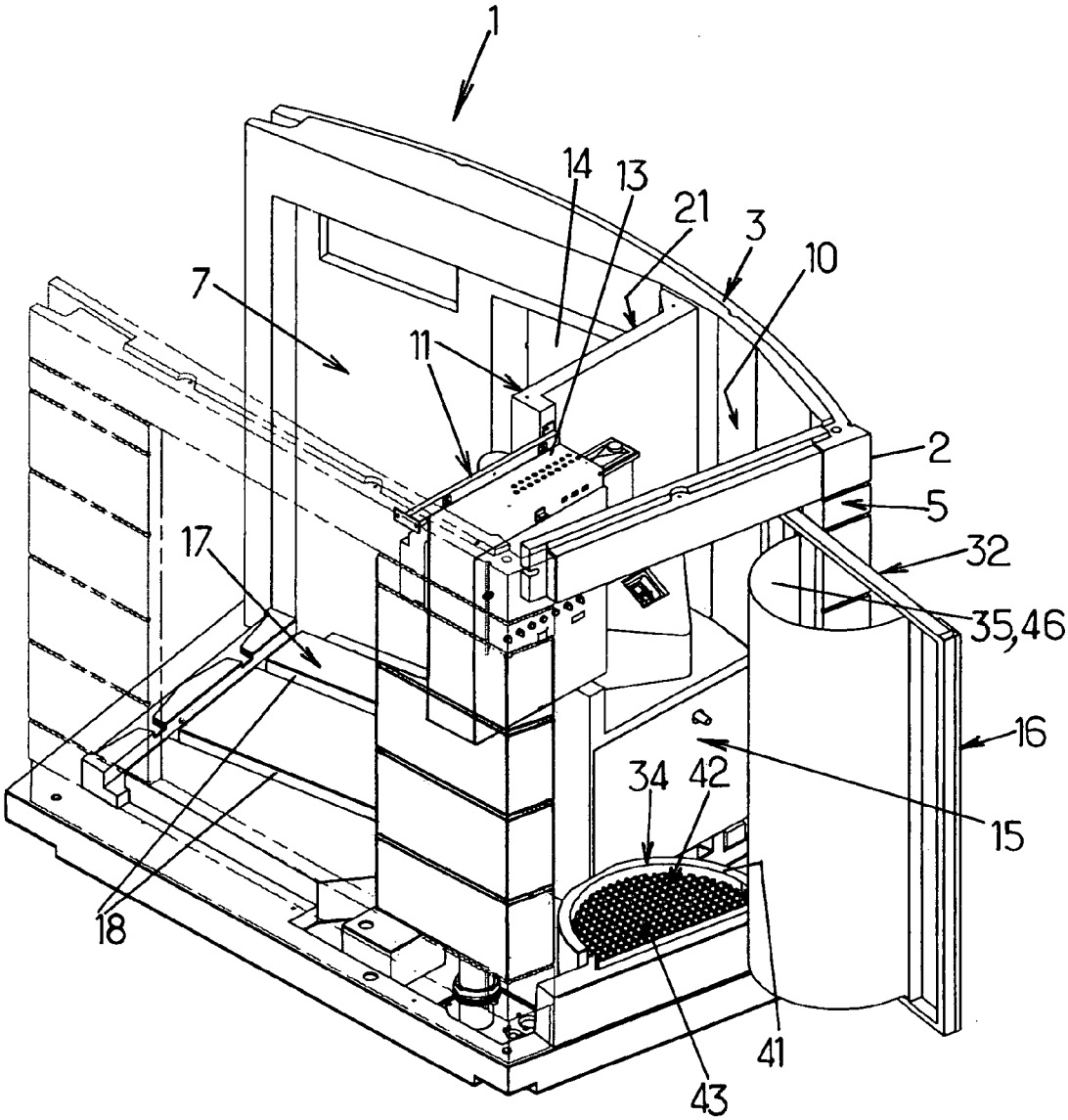
FIG. 5 is a perspective view, with some parts torn away, of the public convenience of FIGS. 2 and 4, along still another angle of sight.

The urinal comprises, on the one hand, a collecting basin 34 which encroaches on the floor of the equipment room 10, and a front wall 35, against which the male urinate, and which is formed in the door 16 of the equipment room 10 (this door is closed on FIG. 1, 2, 3, 6, 7 and open on FIGS. 4 and 5).

As depicted on FIG. 1, the basin 34 presents a circular contour, and the front wall 35, which extends along the contour of the basin 34, is substantially cylindrical. In other words, the front wall 35 is in the form of a vertically-oriented gutter.

Figure 7:
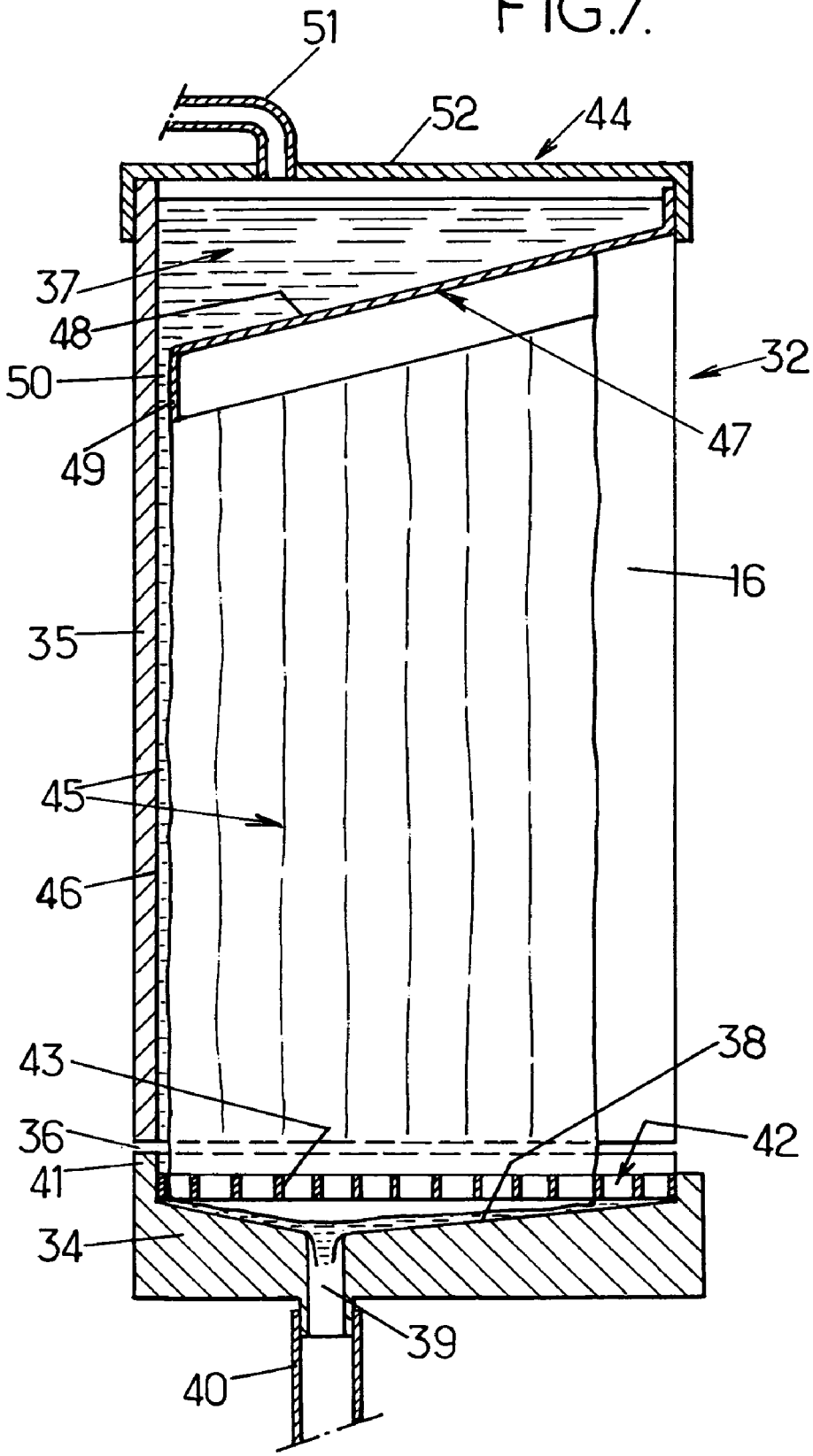
FIG. 7 is a partial cut view of the public convenience of FIG. 1, along the cut plane VII—VII.

Preferably, as depicted on FIG. 7, the basin 34 and the front wall 35 form two separate elements which are located at a certain distance from each other. The resulting interstice 36, which prevents friction when door 16 is opened, is narrow enough for preventing turbulences in the flow of rinsing liquid 37 (which is formed of water, possibly comprising some cleaning additives), so that the rinsing liquid 37 is drained in the form of a laminar flow toward the basin 34.

Furthermore, as depicted on FIG. 7, the basin 34 comprises a wide-angled conical seat 38, the lowest zone of which is provided with a hole 39 for evacuation of the rinsing liquid 37 toward an evacuation conduit 40 (only suggested on FIG. 7).

The basin 34 also comprises a peripheral semi-circular rim 41 which defines a housing 42 for a grille or a grating 43 adapted for supporting the weight of a person, while letting the liquid—which might splash him—flow through, thereby providing good hygiene.

In addition, as depicted on FIG. 7, the convenience 1 is equipped with a water supply 44 specific to the urinal 32, designed to perform a water curtain 45 which flows onto the surface 46 of the front wall 35.

More precisely, the water supply 44 is designed so as to perform a water curtain 45 onto a centered angular portion only of the surface 46, in ordrer to prevent risks that the water flow be deviated toward the outside of the convenience 1 (FIG. 7).

To this end, the water supply 44 comprises a water tank 47 located above the urinal 32 and which forms an inclined channel 48 comprising a lip 49 taking the shape of the surface 46 of the front wall 35 and providing an interstice 50 through which the water 37 of the tank 47 flows out.

An actuating mechanism controlling the emptying of the water tank 47—and also its water refilling—may be provided, either under manual or automated command (this mechanism may comprise a photoelectric cell sensing the presence and/or the absence of a user).

However, the tank 47 may be permanently water refilled and permanently flow out into the urinal 32. A permanent flow would prevent drying of the surface of the front wall 35.

Indeed, the drying of the wall 35 results in capillary phenomenon which prevents a uniform spreading of the water on the surface 46 of the front wall 35, since flowing water tends to shrink into a thin central trickle of water, thereby affecting the quality of evacuation.

In order to provide an uniform spreading of the water flowing under the form of a stable curtain 45, the front wall 35 is preferably coated with a hydrophilic substance which enables water to flow in a laminar way against the wall 35.

Such coating may either be renewed periodically or composed of a film applied against the surface 46 of the front wall. Such a product may be found in everyday commerce.

Of course, it is possible to regulate the position and shape of the channel 48 in function of the desired flow rate.

The inventors remarked that an interstice 50 of several millimeters—e.g. 2 mm—provides a laminar flow having a flow rate which is sufficient for allowing quick and efficient evacuation of urine.

In the example depicted on FIG. 7, the filling of tank 47 is done permanently through a feeding conduit 51 (only suggested on FIG. 7), connected to a cover 52 which closes tank 47 in its upper part.

Although the access to the urinal 32 may be free of charge, it might also be restricted, e.g. through a payment system.

Figure 6:
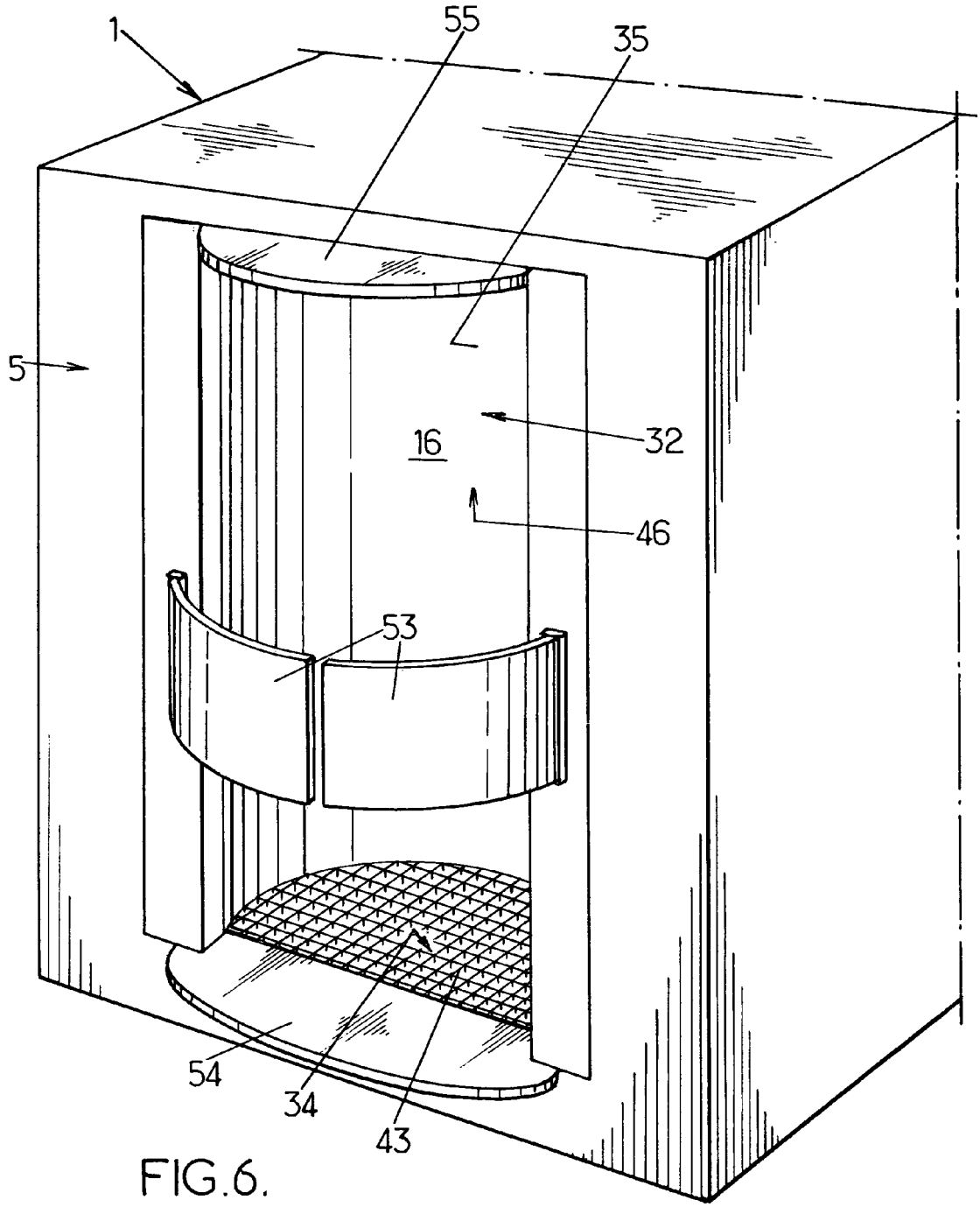
FIG. 6 is partial perspective view of the public convenience of the preceding figures, equipped with an access gate.

As depicted on FIG. 6, the public convenience 1 may be equipped with a gate operable either manually or automatically between a closed position (as represented on FIG. 6) in which it prevents access to the urinal 32, and an open position (not shown) in which, for example when payment is done, it allows a person to access the urinal 32.

In addition, for comfort purposes, the convenience may be equipped, before the urinal 32, with a footboard 54 which is located in prolongation of the grating 43 and increases the available space area on the floor of the urinal 32.

Moreover, the convenience 1 may also be equipped with a weather-board 55 located above the urinal 32 in order to shield the users from bad weather.

The invention claimed is:

1. Convenience (1) comprising a sanitary compartment (7) having a toilet bowl (8), and an equipment room (10) separated from the sanitary compartment (7) and accessible through a door (16) from the outside of the convenience (1), independent from the sanitary compartment access, said convenience (1) further comprising a urinal (32), which is at least partly formed in the door (16) of the equipment room (10) and separated from the sanitary compartment (7).

2. Convenience (1) according to claim 1, wherein the urinal (32) extends at least partly in the equipment room (10).

3. Convenience (1) according to claim 2, wherein the urinal (32) comprises a collecting basin (34) which encroaches on the floor of the equipment room (10), and a front wall (35) formed in the door (16) of the equipment room (10).

4. Convenience (1) according to claim 3, wherein said front wall (35) extends along the contour of the collecting basin (34).

5. Convenience (1) according to claim 4, wherein said front wall (35) is substantially cylindrical.

6. Convenience (1) according to any of claims 3–5, further comprising a grille (43) mounted onto the collecting basin (34), said grille (43) being able to support a person's weight.

7. Convenience (1) according to any of claims 3–6, further comprising a water supply (44) suitable for forming a water curtain (45) running onto a surface (46) of said front wall (35).

8. Convenience (1) according to claim 7, wherein said water supply (44) comprises a water tank (47) located above the urinal (32).

9. Convenience (1) according to claim 8, further comprising a device for controlling draining of the water tank (47) into the urinal (32).

10. Convenience (1) according to any of claims 3–9, wherein said front wall (35) is coated with a hydrophilic substance.

11. Convenience (1) according to any of claims 1–10, further comprising a gate (53) restricting the access to the urinal (32).

12. Convenience (1) according to any of claims 1–11, further comprising a weather-board (55) located above the urinal (32) for shielding the users from bad weather.

13. Convenience (1) according to any of claims 1–12, further comprising a footboard (55), located before the urinal (32).

* * * * *